US007921529B2

(12) United States Patent
Cheatham et al.

(10) Patent No.: US 7,921,529 B2
(45) Date of Patent: Apr. 12, 2011

(54) METHOD OF SMOOTHING A CONTAINER

(75) Inventors: Zachary Cheatham, Lynchburg, VA (US); Rusty Bateman, Lynchburg, VA (US); S. Ali Asghar, Lynchburg, VA (US); Michael Supernaw, Lynchburg, VA (US); Harold James Marshall, Forest, VA (US)

(73) Assignee: Belvac Production Machinery, Inc., Lynchburg, VA (US)

( * ) Notice: Subject to any disclaimer, the term of this patent is extended or adjusted under 35 U.S.C. 154(b) by 0 days.

(21) Appl. No.: 12/781,502

(22) Filed: May 17, 2010

(65) Prior Publication Data

US 2010/0218355 A1 Sep. 2, 2010

Related U.S. Application Data

(62) Division of application No. 11/389,504, filed on Mar. 27, 2006.

(51) Int. Cl.
*B24B 39/00* (2006.01)
*B21C 37/30* (2006.01)

(52) U.S. Cl. ..... 29/90.01; 29/90.2; 29/90.3

(58) Field of Classification Search ..... 29/90.01, 29/90.2, 90.3, 90.5
See application file for complete search history.

(56) References Cited

U.S. PATENT DOCUMENTS

| | | | |
|---|---|---|---|
| 6,543,139 | B2 | 4/2003 | Usui |
| 6,560,835 | B2 | 5/2003 | Porter et al. |
| 6,568,057 | B2 | 5/2003 | Okeda et al. |
| 7,115,172 | B1 | 10/2006 | Teodorovich |

OTHER PUBLICATIONS

Applicants inform the PTO that an offer for sale was made more than one year before the date of this application of a device represented by the attached figures. Additional information is available upon request.

US Office Action on 054034-0133 DTD Jul. 21, 2010.

*Primary Examiner* — Jermie E Cozart
(74) *Attorney, Agent, or Firm* — Foley & Lardner LLP

(57) ABSTRACT

A burnishing tool including a tapered cam shaft including a camming surfaces having a planar spatial orientation substantially the same as the planar spatial orientation of sides of a pyramid, wherein respective keys respectively extend along respective camming surfaces of the tapered cam shaft, the keys having respective longitudinal axis of extensions parallel to the respective camming surfaces and lying in respective planes normal to the planar spatial orientations of the respective camming surfaces, wherein the camming surfaces are arrayed about a cam shaft axis that is normal to a plane that is parallel to a base of the pyramid. The burnishing tool further includes a burnishing assembly, the burnishing assembly includes segmented burnishing components including respective cammed surfaces positioned on the tapered cam shaft adjacent respective camming surfaces. These segmented burnishing components include mate with the cam shaft.

6 Claims, 18 Drawing Sheets

METHOD OF SMOOTHING A CONTAINER

CROSS-REFERENCE TO RELATED PATENT APPLICATIONS

This application is a Divisional of U.S. patent application Ser. No. 11/389,504, filed Mar. 27, 2006, incorporated herein by reference in its entirety and has been allowed.

BACKGROUND OF THE INVENTION

Plastic bottles and containers, such as, for example, bottles that contain liquids, often develop burrs at or near the opening of the bottle/container during trimming. An example of such burrs may be seen in the container 1000 depicted in FIG. 3, where burrs 1020 and 1040 are seen on the top sealing surface and the inner edge inside, respectively, of the container 1000.

SUMMARY OF THE INVENTION

There is thus a need for an advanced finishing or "burnishing" (as that term is defined herein) tool is to smoothen out or burnish off or otherwise remove the aforementioned burrs in an automatic bottle/container making assembly line. One use of such a finishing/burnishing tool may be to accomplish this without creating undesirable plastic chips or dust.

Burnishing is the process of smoothing out the surface akin to ironing a wrinkled fabric without creating any debris. This may be achieved by, for example, the rotating action of the container with respect to the non-rotating tool.

The working surface of the tool may be highly polished and free from any debris or burrs thus creating a smooth finish by "ironing out" the surface of the bottle/container without the creation of plastic chips or dust.

Two types of finishing/burnishing tools may be employed to remove and smoothen out the container opening: (a) an Expanding tool, or (b) a fixed Non-expanding tool. The type of tool utilized may depend on the of final "finish" desired.

Accordingly, in an embodiment of the present invention, there is a burnishing tool, comprising, a tapered cam shaft, wherein the tapered cam shaft includes for example 3 (three) camming surfaces having a planar spatial orientation substantially the same as the planar spatial orientation of sides of a pyramid, wherein respective keys respectively extend along respective camming surfaces of the tapered cam shaft, the keys having respective longitudinal axis of extensions parallel to the respective camming surfaces, wherein the longitudinal axis of extensions lie in planes that are respectively normal to the base legs of the pyramid, and wherein the camming surfaces are arrayed around the cam shaft axis that is normal to a plane that is parallel to a base of the pyramid. The burnishing tool further comprises a burnishing assembly, the burnishing assembly including segmented burnishing components including respective cammed surfaces positioned on the tapered cam shaft adjacent respective camming surfaces, wherein the segmented burnishing components include respective keyways substantially extending along the respective cammed surfaces to accept the respective keys of the tapered cam shaft, the respective keyways having a longitudinal axis of extension substantially parallel to the longitudinal axis of extension of the respective keys, and wherein the segmented burnishing components have burnishing surfaces.

The tool further includes, for example, a garter spring, the garter spring or similar device applies a force on the segmented tool components to hold the segmented tool components against the tapered cam shaft. In this embodiment, the burnishing tool is configured to adjust the position of the burnishing assembly with respect to the tapered cam shaft in the direction of the cam shaft axis to advance and retract the segmented burnishing components in a radial direction with respect to the cam shaft axis due to movement of the cammed surfaces of the segmented burnishing components along the respective camming surfaces of the cam shaft.

In another embodiment of the present invention, there is a fixed non-expanding tool includes various finishing tool surfaces that work on the rough surfaces of the container opening. In an exemplary embodiment, there is a burnishing tool, comprising a plurality of burnishing surfaces arrayed about a longitudinal axis of the burnishing tool substantially on the same plane, wherein the plurality of burnishing surfaces are respectively separated by sections of the tool that at least one of (i) does not have a burnishing surface and (ii) does not have a burnishing surface on the same plane as the plurality of burnishing surfaces, and wherein the burnishing surfaces are non-movable.

In another embodiment, there is a burnishing tool as just described, further comprising a canted burnishing surface, the canted burnishing surface being at a substantial angle with respect to the plane.

DETAILED DESCRIPTION OF SOME EMBODIMENTS

Figure 1A:
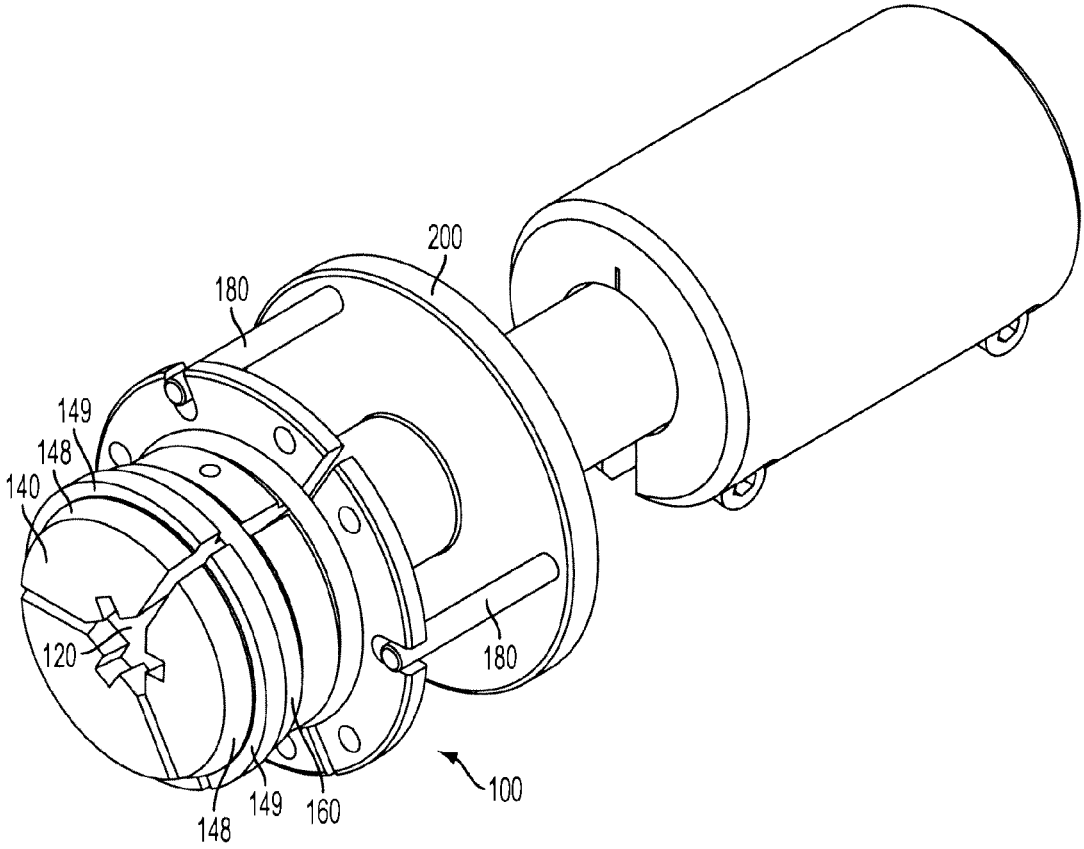
FIG. 1*a* is a schematic of a burnishing tool according to an exemplary embodiment of the present invention.

FIG. 1*a* depicts a burnishing tool 100 according to an exemplary embodiment of the present invention, that includes a cam shaft 120 and a burnishing assembly 140 held to the cam shaft 120 by a carrier assembly 160. These components will now be described in greater detail.

Figure 1B:
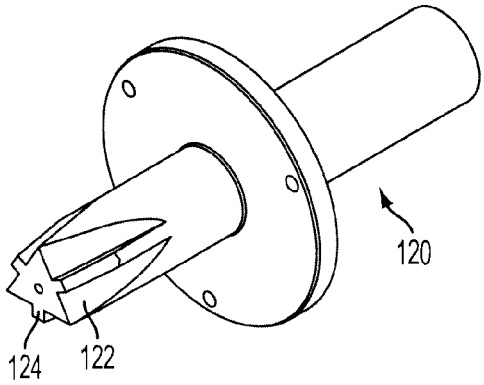
FIGS. 1*b*-1*d* are schematics of components of the burnishing tool depicted in FIG. 1.
Figure 2A:
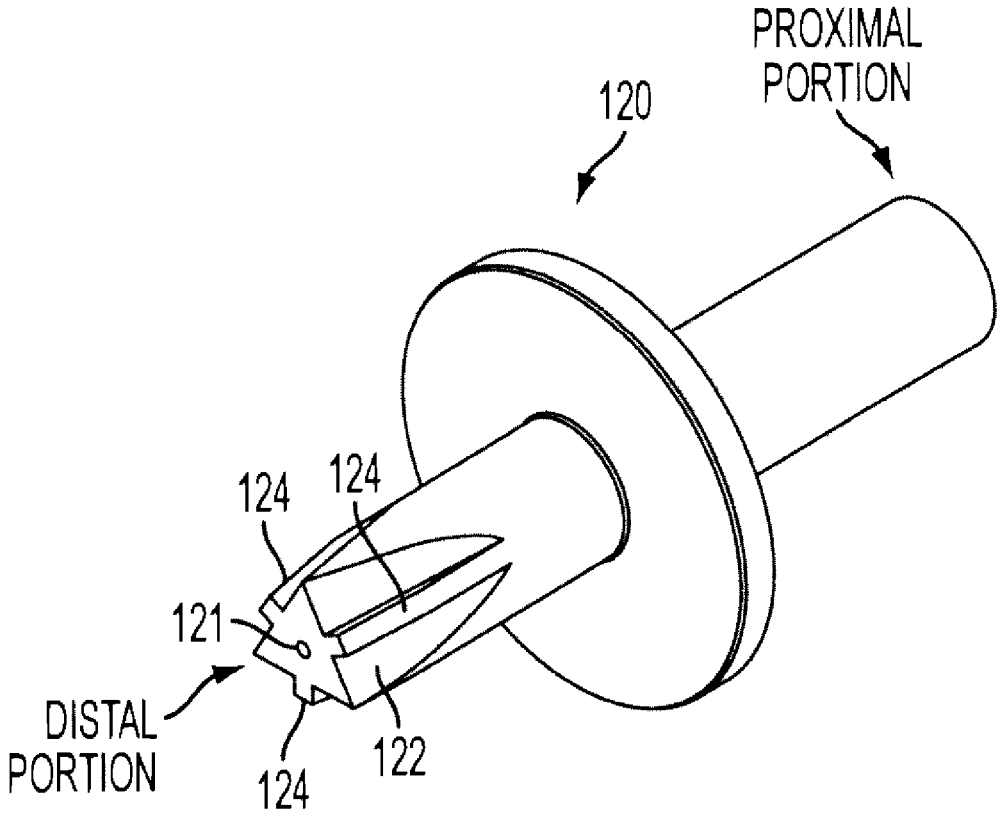
FIG. 2*a* is a schematic of a component of the burnishing tool depicted in FIG. 1
Figure 2B:
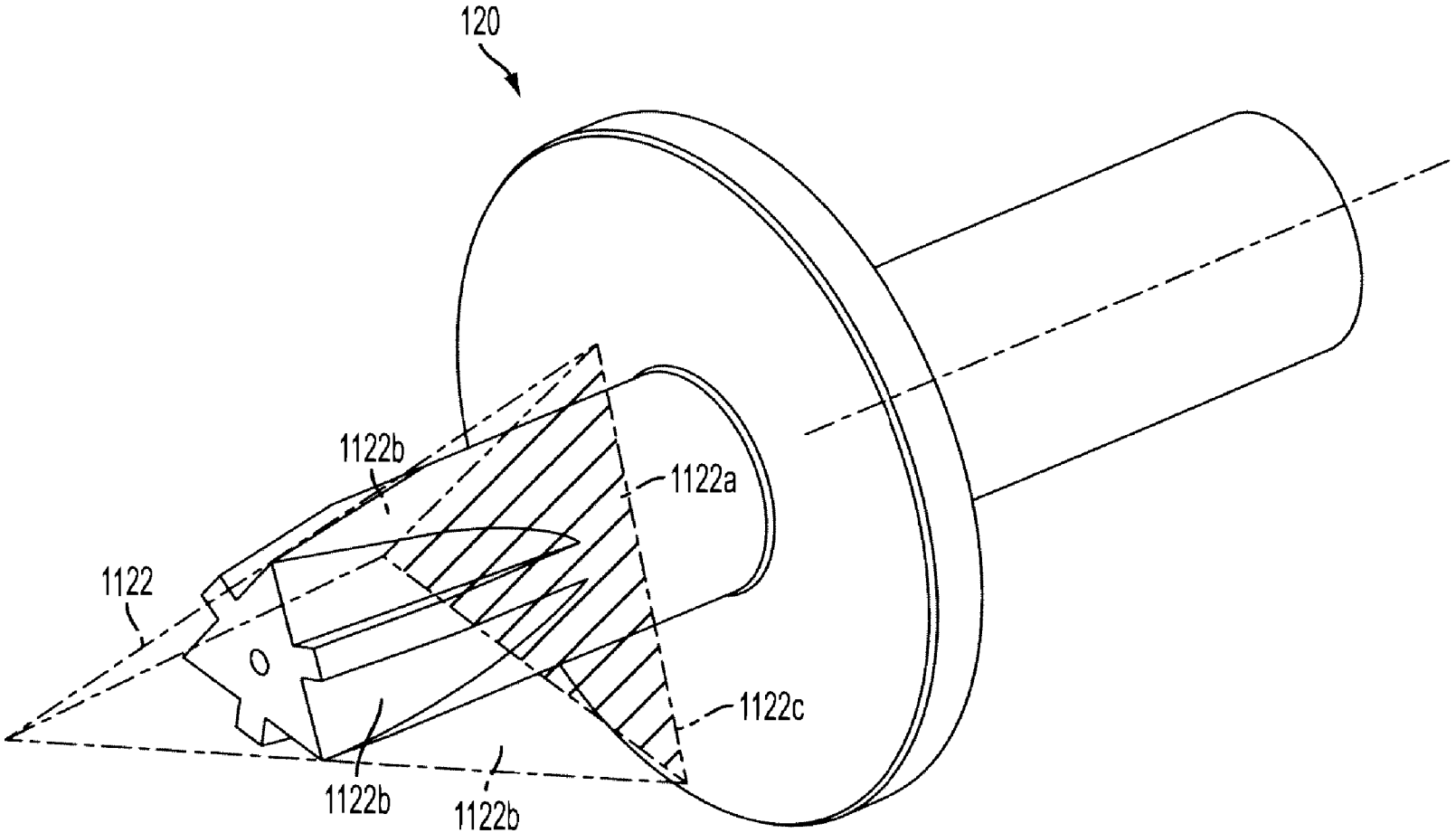
FIG. 2*b* is an elaboration on the concept of defining the camming surfaces of the cam shaft by a pyramid.
Figure 2D:
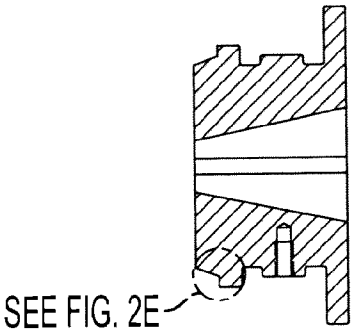
FIGS. 2*c*-2*f* present further details of components of the burnishing tool depicted in FIG. 1.
Figure 2F:
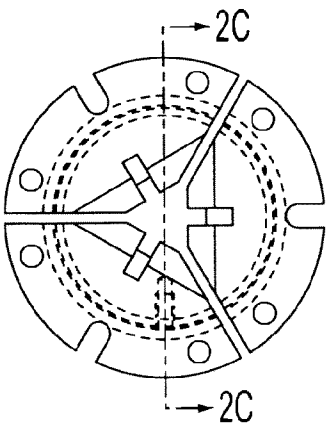
Figure 2C:
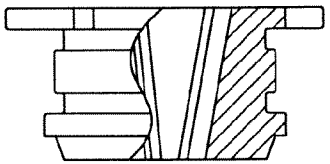
Figure 2E:
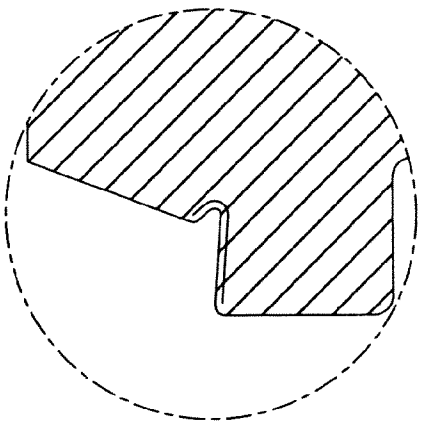

FIGS. 1*b*, 2*a* and 2*b* depict a view of the cam shaft 120 un-obscured by the other components of the burnishing tool 100. As may be seen in FIG. 1*b*, the cam shaft 120 is a tapered cam shaft including camming surfaces 122 and keys 124. In one embodiment, the camming surfaces have a planar spatial orientation substantially the same as the planar spatial orientation of sides of a pyramid 1122 having a base 1122*a* and sides 1122*b*, as is exemplarily depicted in FIG. 2*b*. That is, the pinnacle of the pyramid 1122 may be located closer to the distal portion of the cam shaft 120 than the proximal portion of the cam shaft 120, while the base 122*a* may be located closer to the proximal portion of the cam shaft 120 than the distal portion of the cam shaft 120. Also, the pinnacle may be located on the centerline of the cam shaft, while the base is centered about the centerline of the cam shaft, and thus the sides and camming surfaces are arrayed uniformly around the centerline of the cam shaft. However, in other embodiments of the present invention, this may not be the case.

In the embodiment depicted in FIG. 2*b*, the pyramid is a triangular pyramid, although in other embodiments of the present invention, it may be a rectangular pyramid, a square pyramid, a pentagonal pyramid, a hexagonal pyramid, and a heptagonal pyramid, or any other type of pyramid that may be utilized to impart a camming action onto the burnishing assembly. Accordingly, the number of camming surfaces will correspond to the number of sides of the pyramid.

As may be seen in FIGS. 1*b*, 2*a* and 2*b*, the cam shaft 120 includes keys 124. In the embodiment depicted, respective keys 124 extend along respective camming surfaces of the tapered cam shaft 120. The keys have respective longitudinal axis of extensions (i.e., the axis along which the keys extend) that are parallel to the respective camming surfaces consistent with the fact that the keys extend along the camming surfaces. Moreover, the longitudinal axis of extensions lie in planes that are respectively normal to the base legs 1122*c* of the pyramid.

Figure 1C:
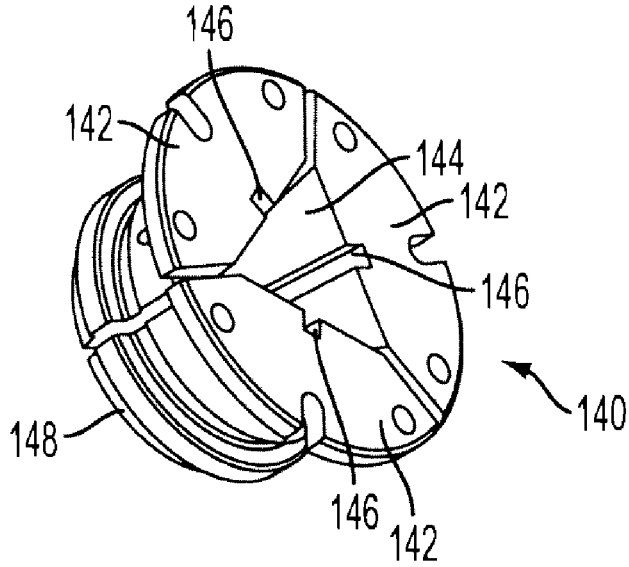
Figure 1D:
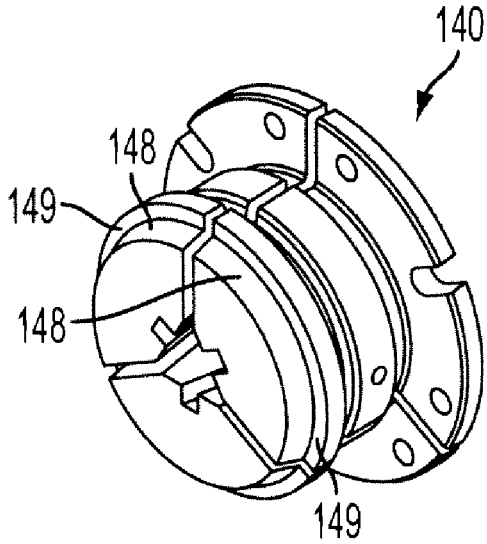

FIGS. 1*c* and 1*d* present an unobstructed view of the burnishing assembly 140. As may be seen, in the present exemplary embodiment, the burnishing assembly 140 includes three segmented burnishing components 142, reflecting the number of sides of the pyramid. These burnishing components 142, in this embodiment, may be obtained from a single machined component turned on a lathe and then separated out from the single machined component, although in other embodiments, they may be separately manufactured. (FIGS. 2*c*-2*f* depict detailed views of the burnishing assembly according to the embodiment depicted in FIGS. 1*a*, 1*c* and 1*d*.)

In FIG. 1*c*, cammed surfaces 144 of the burnishing components 142 may be seen. These cammed surfaces 144 are positioned, as may be seen in FIG. 1*a*, on the tapered cam shaft adjacent respective camming surfaces 122. In an exemplary embodiment of the present invention, when the segmented burnishing components are positioned on the tapered cam shaft 120, the cammed surfaces 144 lie in planes that collectively lie in the planes formed by sides of a pyramid in a manner concomitant to that of the camming surfaces 122. This phenomenon may also be seen in FIG. 1*c*.

As may be seen from FIGS. 1-1*d*, the segmented burnishing components include respective keyways 146 substantially extending along the respective cammed surfaces. In the exemplary embodiment depicted, the keyways 146 are dimensioned and positioned to accept the respective keys 124 of the tapered cam shaft 120. That is, the respective keyways 146 have a longitudinal axis of extension substantially parallel to the longitudinal axis of extension of the respective keys 124 with which the keyways mate. In the depicted embodiment, the key-keyway combination provides axial stability for the burnishing components with respect to the centerline of the tapered shaft, preventing the burnishing components from substantially rotating/sliding about the tapered shaft while permitting the burnishing components to move in the axial direction.

FIGS. 1*a*, 1*c* and 1*d* show that burnishing components 142 include vertical burnishing surfaces 148 and horizontal burnishing surfaces 149. By "vertical burnishing surfaces," it is meant that the surfaces are configured to burnish the inner edge inside of a container via a relative rotation between the container and the burnishing surfaces. (This type of tool may also be referred to as a 180 degree tool.) By "horizontal burnishing surfaces," it is meant that the surfaces are configured to burnish the top seal surface of a container via a relative rotation between the container and the burnishing surfaces. (This type of tool may also be referred to as a 90 degree tool.) That is, these are the working surfaces that burnish off the respective burrs of the container.

FIG. 1*a* also shows a carrier assembly 160. In the embodiment depicted, the carrier assembly 160 is made of one or more garter springs that extend about the burnishing assembly. The garter springs are in an extended state, and thus they seek to contract to their normal state, thereby applying an inwardly directed hoop force on the segmented machine components. In an embodiment of the present invention, this holds the segmented machine components against the tapered cam shaft 120.

The burnishing tool 100 is configured to adjust the position of the burnishing assembly 140 with respect to the tapered cam shaft 120 in the direction of the cam shaft centerline/axis to advance and retract the segmented burnishing components 142 in a radial direction with respect to the cam shaft axis due to movement of the cammed surfaces 144 of the segmented burnishing components along the respective camming 122 surfaces of the cam shaft 120.

In the exemplary embodiment depicted in FIG. 1*a*, the burnishing tool 100 includes elements 180 which may be jackscrews respectively connected to the burnishing components 142. In other embodiments of the invention, instead of jackscrews, elements 180 may be dowel pins, and platform 200 is connected to an actuator so that platform 200 moves in the axial direction relative to the cam shaft 120, thereby pulling/pushing the burnishing components 142 in the axial direction as well.

As the burnish components 142 are pulled up the cam shaft 120, the camming surfaces 122 wedge the burnishing components 142 apart, which moves the burnishing surfaces away from the centerline of the cam shaft 120. As the burnish components 142 are pushed down the cam shaft 120, the burnishing components 142 slide back "down" the camming surfaces 122, and thus the carrier assembly 160 pushes the burnishing components 142 towards each other, which moves the burnishing surfaces towards the centerline of the cam shaft 120. That is, the segmented burnishing components are advanced in the radial direction about the cam shaft when the burnishing assembly is moved in a direction along a vector defined by movement away from the distal portion towards the proximal portion, and the segmented burnishing components are retracted in the radial direction about the cam shaft when the burnishing assembly is moved in a direction along a vector defined by movement away from the proximal end towards the distal end.

In another embodiment of the present invention, elements 180, as noted above, may be dowel pins or the like along which burnishing components 142 may travel along, or any device that will accomplish the task of preventing rotation of the burnishing components 142 and/or providing a force that resists a torque on the burnishing components 142. In such embodiments, the tool may be used by simply lowering the tool towards the containers and using the reaction force generated through contact with the containers to drive the burnishing components 142 up the shaft (effectively accomplishing the same result as pulling the components up the shaft as previously detailed). The components 142 may be moved down the shaft through gravity and/or through the compression force generated by the carrier assembly 160 that reacts with the cam shaft, thus driving the components 142 downward.

As may be seen in the figures, cam shaft 120 includes a hole 121 that may be threaded. A bolt (not shown) may be screwed into the hole 121 to hold a large washer-shaped platform to act as a longitudinal barrier to further downward movement of the components 142 along the shaft.

Figure 3:
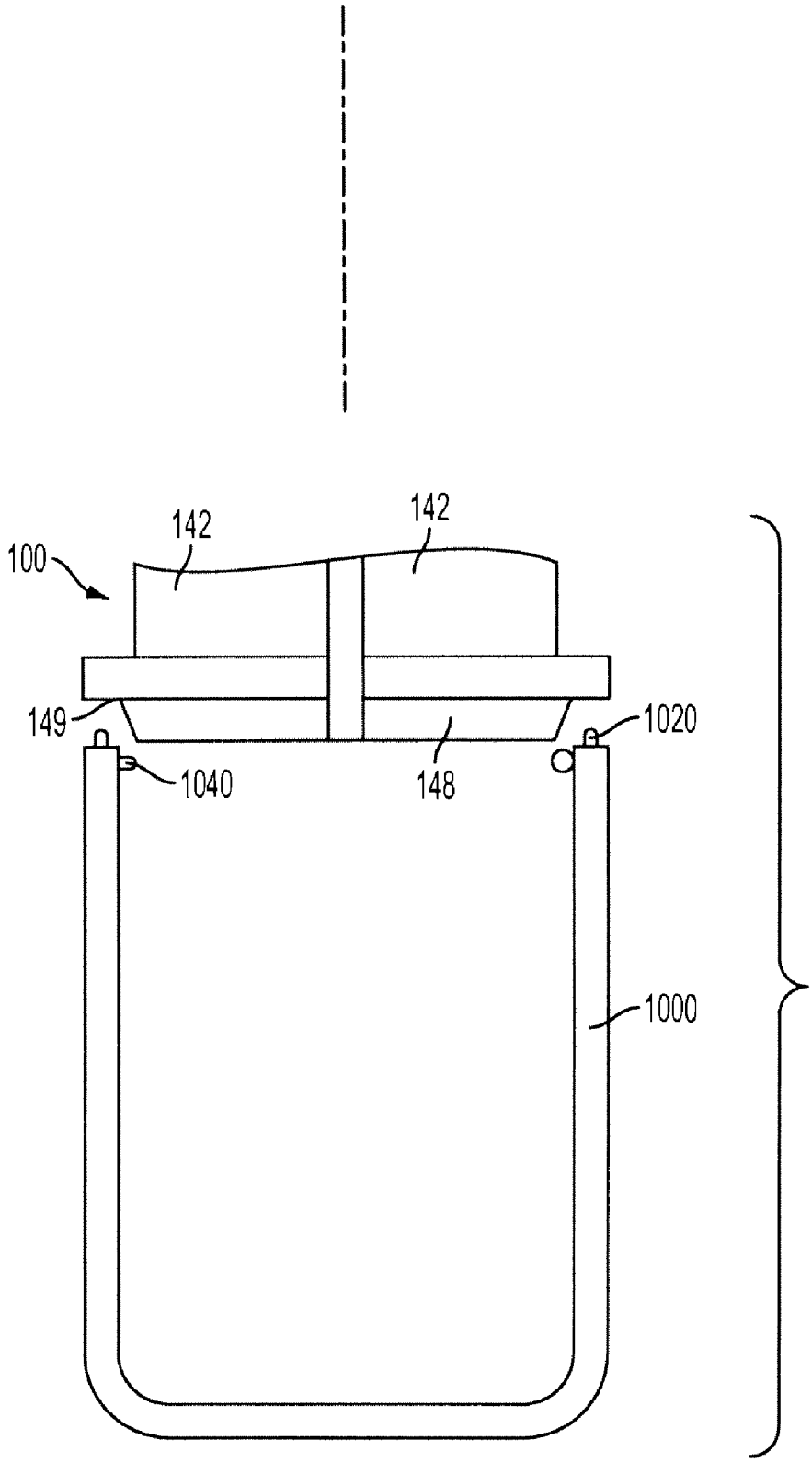
FIG. 3 depicts use of the burnishing tool depicted in FIG. 1.

In operation, in one embodiment of the present invention, as is exemplary depicted in FIG. 3, the container is rotated about the centerline of the cam shaft 120, thereby rotating against the burnishing surfaces 148/149. The burnishing tool 100 is lowered onto and into the mouth of a container 1000 (or visa-versa) and/or the radial position of the burnishing surfaces is adjusted so that the top sealing surface (referred to as TSS) of the container and/or the inner edge inside the container is smoothed and/or removed. (e.g., in FIG. 3, the burrs 1020 and 1040 are removed.) In the present embodiment, the container 1000 is a plastic container, by way of example only and not by way of limitation. In other embodiments, the tool may be rotated while the container is rotated, and/or the tool may be rotated while the container is not rotated. It may be possible to rotate the tool by the addition of slip rings at appropriate locations on the tool. In some embodiments of the present invention, at least one of heat, pressure and/or motion, individually or in combination, provide the physical phenomenon(s) which removes the burrs from the container. In some embodiments, the removal of the burrs accomplished, in whole or in part, through an ironing-like action akin to ironing a piece of wrinkled clothing with a hand iron.

Some alternate designs relating to the embodiment described above will now be discussed.

As noted above, in the embodiment depicted in FIGS. 1-2*b*, the pinnacle of the pyramid 1122 is located closer to the distal portion of the cam shaft 120 than the proximal portion of the cam shaft 120, while the base is located closer to the proximal portion of the cam shaft 120 than the distal portion of the cam shaft 120.

In the embodiment depicted in FIG. 2*a*, the pyramid is a triangular pyramid, although in other embodiments of the present invention, it may be a rectangular pyramid, a square pyramid, a pentagonal pyramid, a hexagonal pyramid, and a heptagonal pyramid, or any other type of pyramid that may be utilized to impart a camming action onto the burnishing assembly. Accordingly, the number of camming surfaces will correspond to the number of sides of the pyramid.

As noted above, in the embodiments depicted in FIGS. 1-2*b*, the longitudinal axis of extensions of the keys/keyways 124/146 lie in planes that are respectively normal to the base legs 1122*c* of the pyramid. However, in other embodiments, the keys/keyways may lie in planes that are not respectively normal to the base legs 1122*c* of the pyramid. Moreover, while the embodiments depicted include keys/keyways having rectangular cross sections, other keys/keyways may have other shaped cross sections, such as, for example, dovetail, circular, triangular, semicircular, etc. Moreover, camming surfaces 122 may have more than one key 124.

As noted above, FIGS. 1*a*, 1*c* and 1*d* show that burnishing components 142 include burnishing surfaces. In the embodiment so depicted, the burnishing surfaces substantially sweep about the entire perimeter of the burnishing assembly 140, and sweep about the entire perimeter of the burnishing components 142. However, in other embodiments of the present invention, one or both of the burnishing surfaces 148 and 149 does not so sweep. By way of example only and not by way of limitation, the burnishing surfaces 148 and/or 149 may be located on burnishing prongs or tabs 152, as may be seen in FIGS. 4 and 5.

By way of exemplary description, the segmented burnishing components include respective horizontal and vertical burnishing surfaces. In this embodiment, referring to FIG. 4*b*, which is a view of the tool of FIG. 4*a* obtained when looking down the longitudinal axis/cam shaft centerline of the tool, the segmented burnishing components 152 are arranged about the longitudinal axis/cam shaft centerline such that the respective vertical burnishing surfaces 148 lie on or substantially near an extrapolated cylindrical surface 374 having a geometric center positioned on or substantially near the longitudinal axis/cam shaft centerline. Further, the segmented burnishing components are arranged about the longitudinal axis/cam shaft centerline such that the respective horizontal burnishing surfaces 149 lie on or substantially near a plane normal to the longitudinal axis.

Figure 4A:
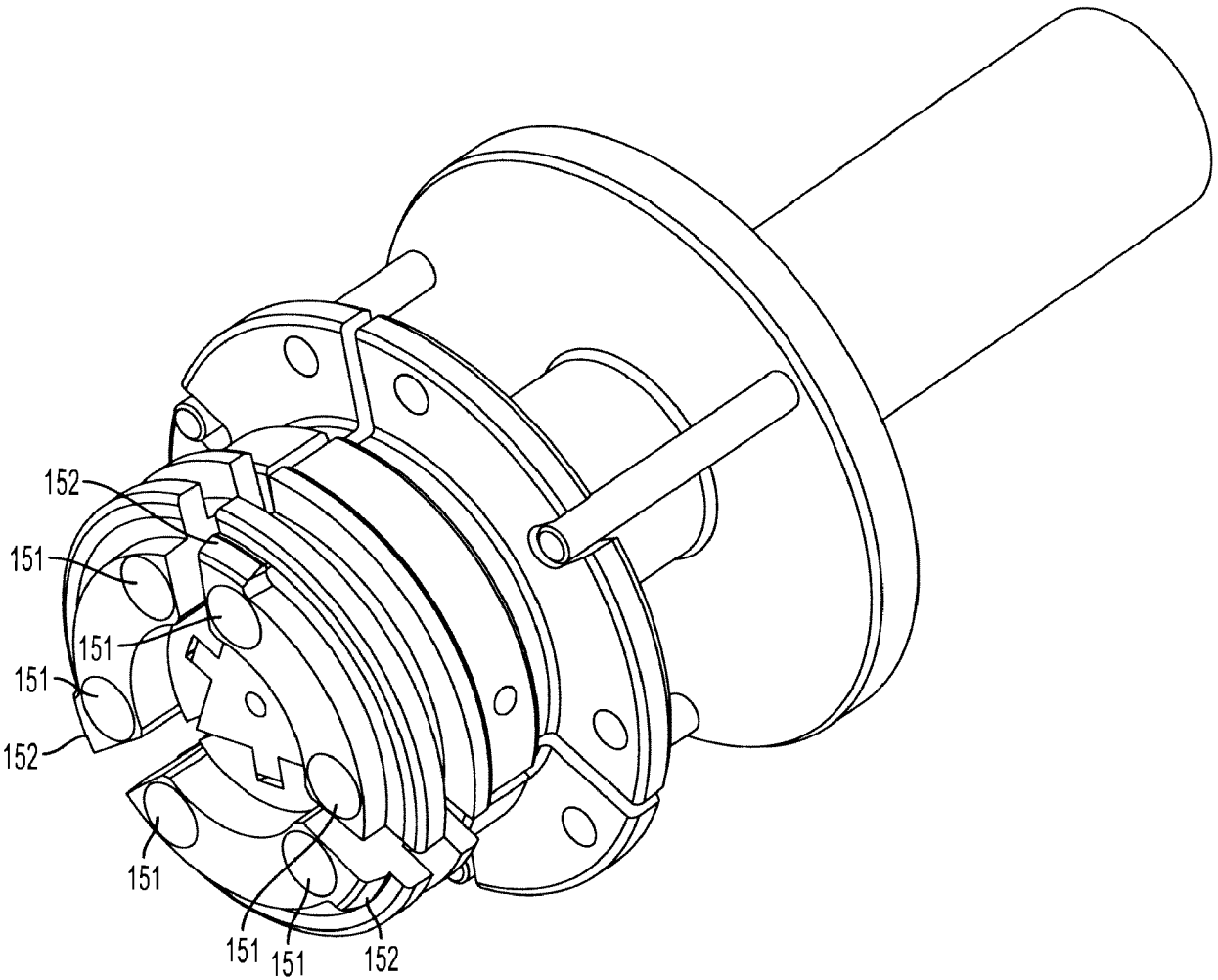
FIG. 4*a* is a schematic of another embodiment of the burnishing tool according to the present invention.
Figure 4B:
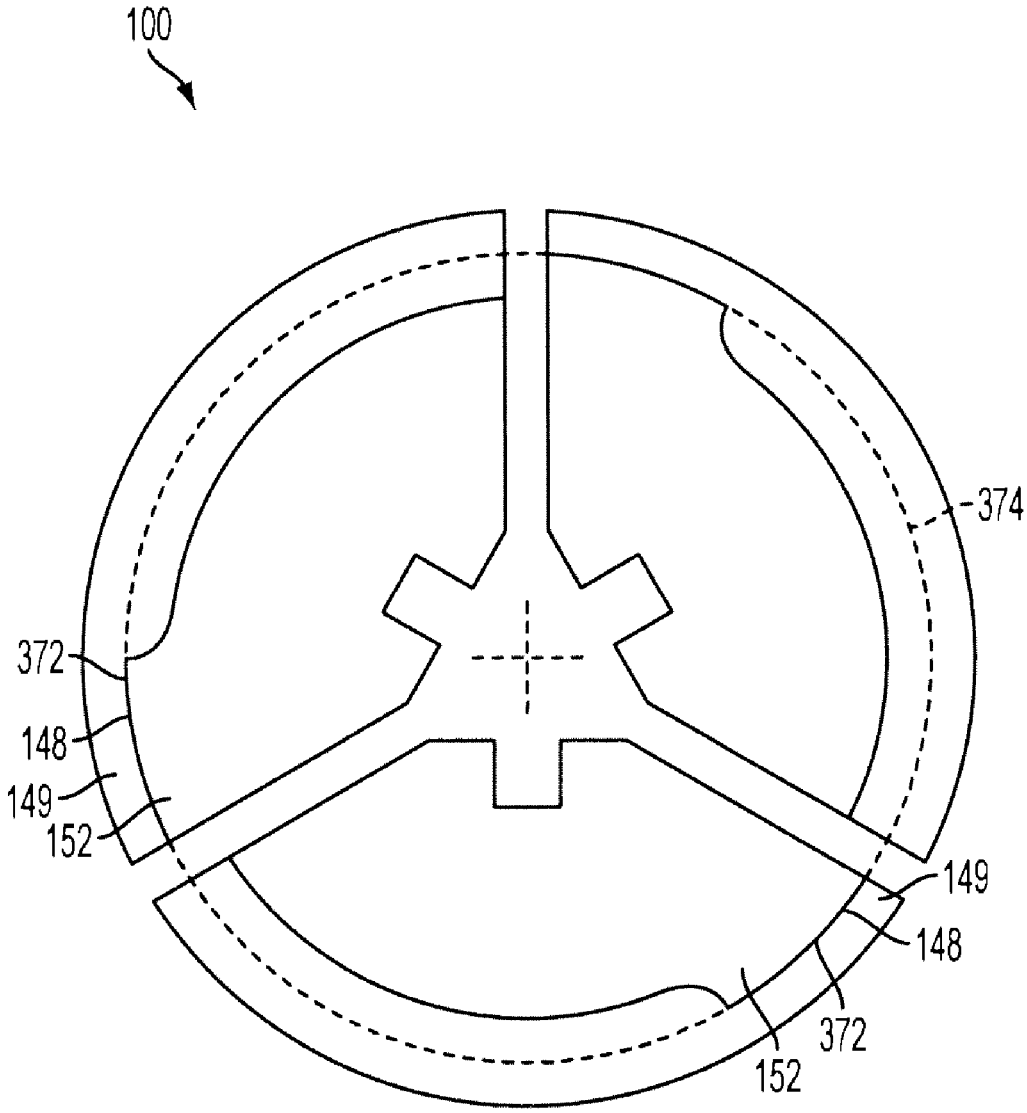
FIG. 4*b* is a partial schematic of the device of FIG. 4*a* when viewed along the centerline of the device.

With the just described geometry in mind, referring to FIG. 4*b*, the vertical burnishing surfaces 148 of burnishing prongs/tabs/studs 152 are configured such that a series of arcs 372 formed by the intersection of (i) the vertical burnishing surfaces 148 that lie on or substantially near the extrapolated cylindrical surface 374 and (ii) a plane normal to the longitudinal axis collectively extend less than about, by way of descriptive example only, 180, 90, 45, and 25 degrees about the longitudinal axis (about 35 degrees being exemplary shown in FIG. 4*b*). While not explicitly shown, the horizontal burnishing surfaces may be configured such that a series of arcs formed by the intersection of (iii) the horizontal burnishing surfaces that lie on or substantially near the plane normal to the longitudinal axis and (iv) a cylindrical surface having as its axis the longitudinal axis collectively extends less than about, by way of descriptive example only, 180, 90, 45 and 25 degrees about the longitudinal axis of the burnishing tool. (It is noted that the just mentioned angles are recited as angles that represent the concept depicted in FIGS. 4 and 5, and thus other embodiments of the present invention may include lower angles or higher angles.)

Figure 5:
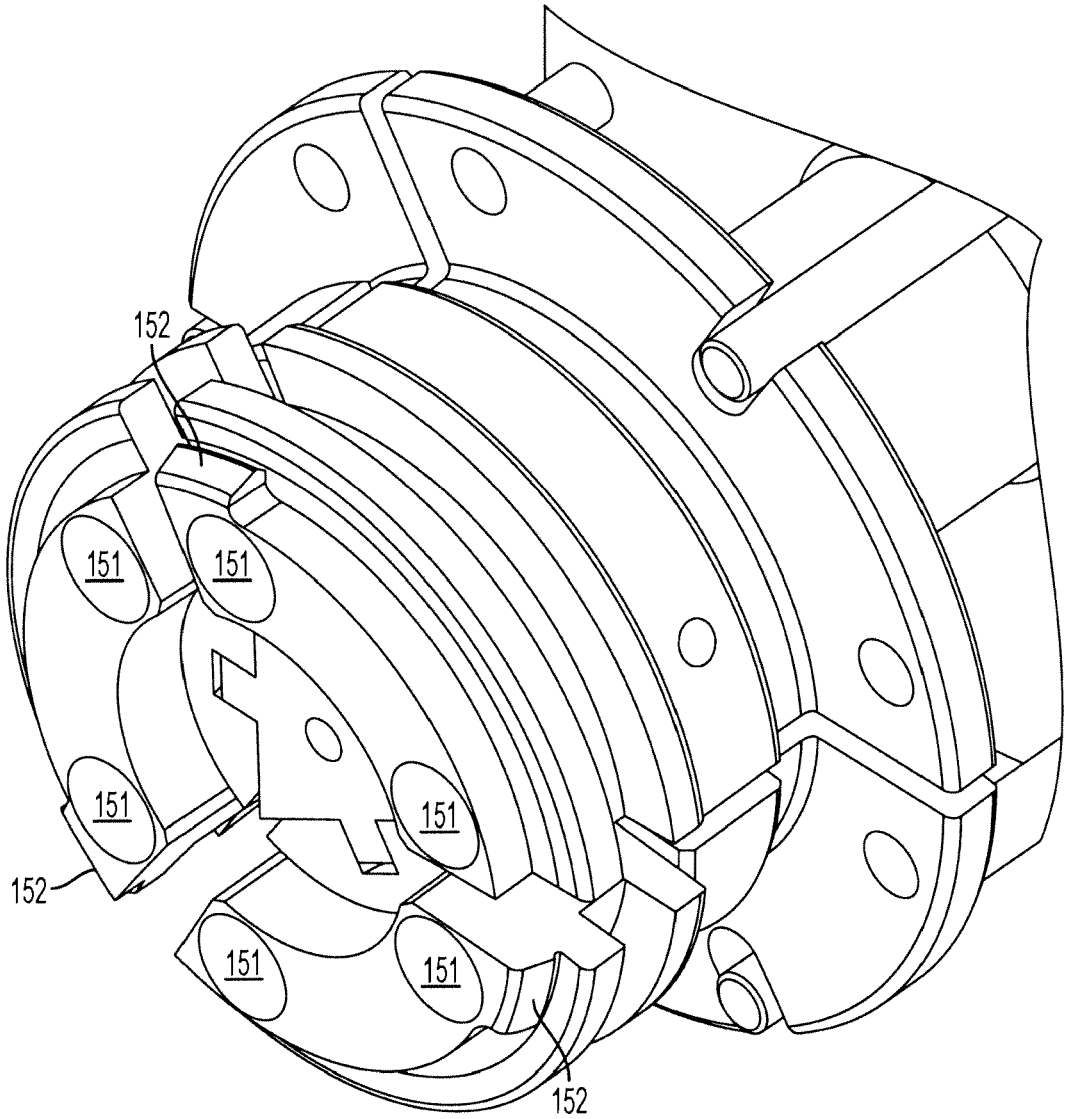
FIG. 5 is a close-up view of a portion of the embodiment depicted in FIG. 4*a*.

It is noted that in the configurations of FIGS. 4*a*-5, the portions of the tool having the burnishing surfaces may be removed and replaced by, for example, undoing bolts holding these components together. These bolts may be located in bolt holes 151.

As noted above, a carrier assembly 160 is utilized to apply force to the burnishing components 142 to hold them against the cam shaft 120. While the embodiment depicted shows the use of garter springs, in other embodiments of the invention, rubber o-rings may be used. In other embodiments of the invention, an electrometric element may be used, while in other embodiments of the invention, spring-biased tie-bars 166 may be used. Basically, any device or method that will impart a compressive force on the burnishing components 142 to push the components towards the cam shaft 120 may be used to practice the present invention.

Further, any device or method that will allow for the position of the burnishing assembly 140, with respect to the tapered cam shaft 120 to be adjusted in the direction of the cam shaft centerline/axis to advance and retract the segmented burnishing components 142 in a radial direction with respect to the cam shaft axis due to movement of the cammed surfaces 144 of the segmented burnishing components along the respective camming 122 surfaces of the cam shaft 120 may be used to practice the present invention.

Figure 6:
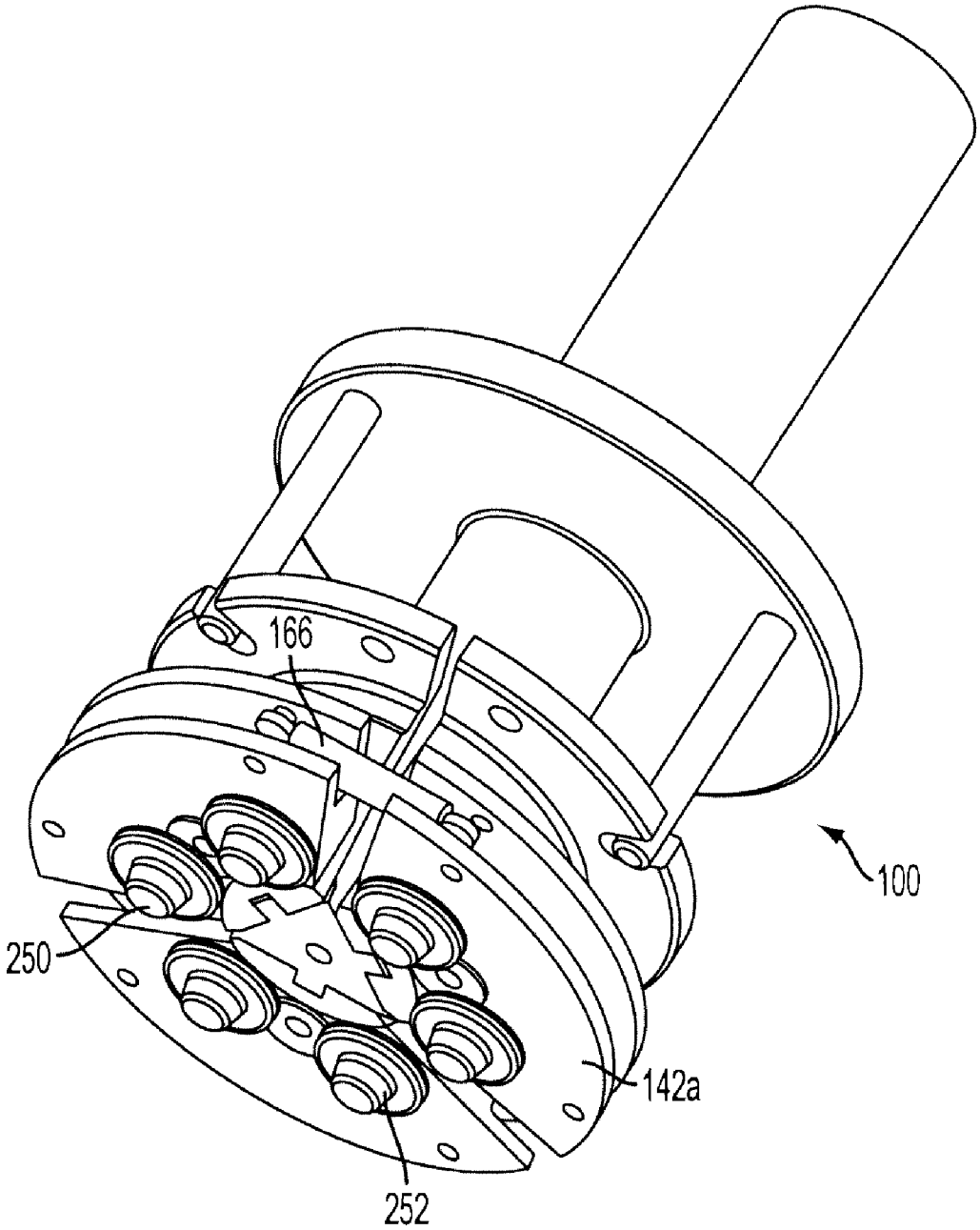
FIG. 6 is a schematic of another embodiment of the present invention, showing profiled button tools in place of a machined surface.

FIG. 6 schematically illustrates another embodiment of the present invention, where instead of burnishing prongs and/or tabs 152, burnishing buttons 250 are used to supply burnishing surfaces. These buttons may be attached to the burnishing components 142*a*, which operate in a substantially similar/same manner as the burnishing components 142 vis-camming due to the cam shaft 120 as detailed above.

In the embodiment depicted in FIG. 6, the burnishing buttons have a closed circular surface 252, while in other embodiments, the buttons 250 have a closed arcuate surface, which may take the form of, by way of example and not by limitation, an ellipse or a half-moon shape. In the embodiment of FIG. 6, a portion of the closed circular surfaces (or closed arcuate surfaces) form the respective burnishing surfaces.

Figure 7:
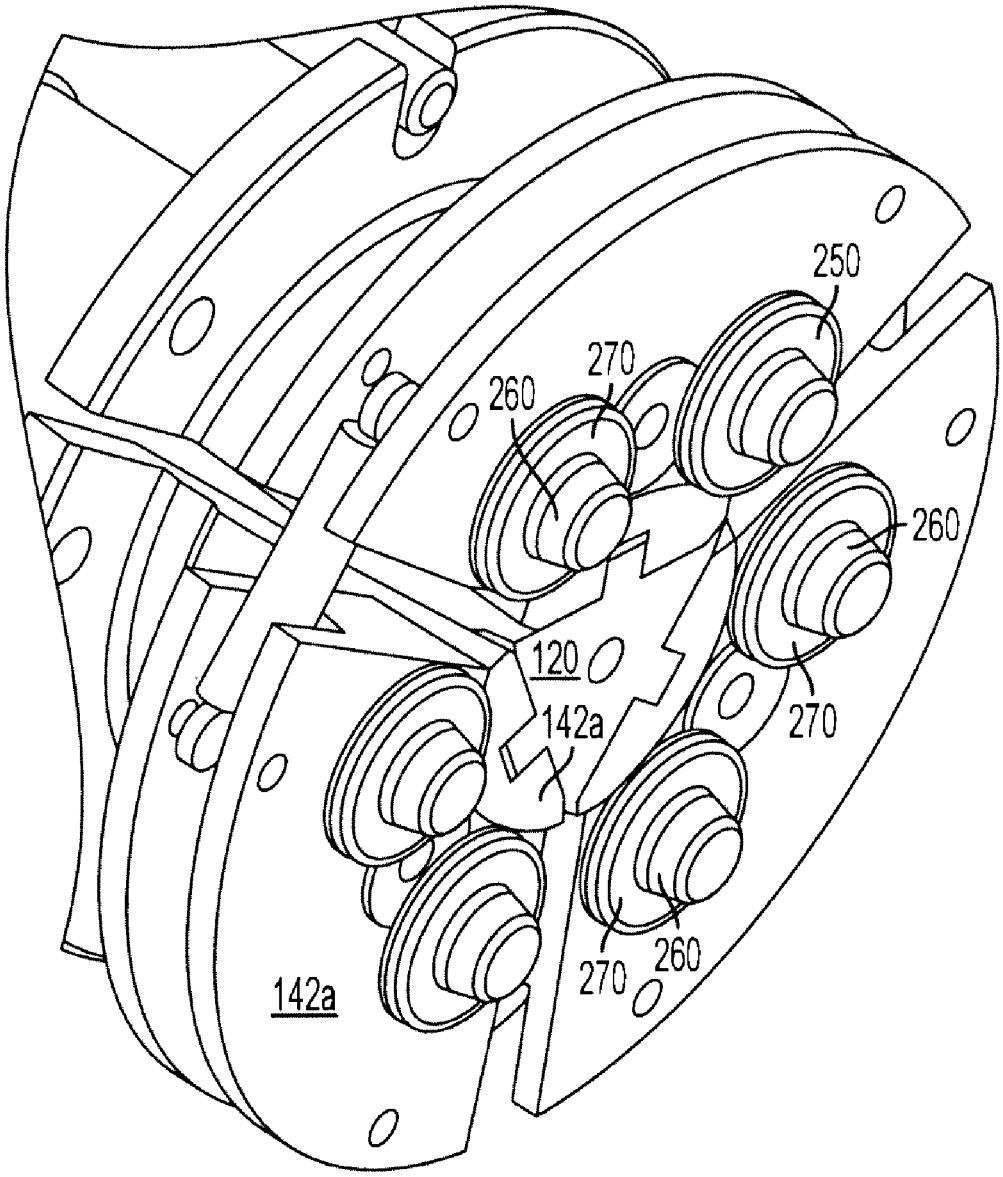
FIG. 7 is a close-up view of a portion of the embodiment depicted in FIG. 6.

FIG. 7 is an enlarged view of a portion of FIG. 6. As may be seen, burnishing buttons 250 include both vertical burnishing surfaces 260 as well as horizontal burnishing surfaces 270.

In an exemplary method utilizing the embodiment depicted in FIGS. 6-7, the container 100 is rotated about the centerline of the cam shaft 120, thereby rotating the burnishing buttons 250 and thus the burnishing surfaces 260 and 270. The burnishing tool 100 is lowered onto and into the mouth of a container and/or the radial position of the burnishing surfaces is adjusted so that the top sealing surface of the container and/or the inner edge inside the container is smoothed and/or removed. That is, operation is similar to the operation detailed above with respect to FIG. 3, except that the burrs 1020 and 1040 of container 1000 are removed via vertical and horizontal surfaces 260 and 270 instead of surfaces 148 and 149.)

Figure 8:
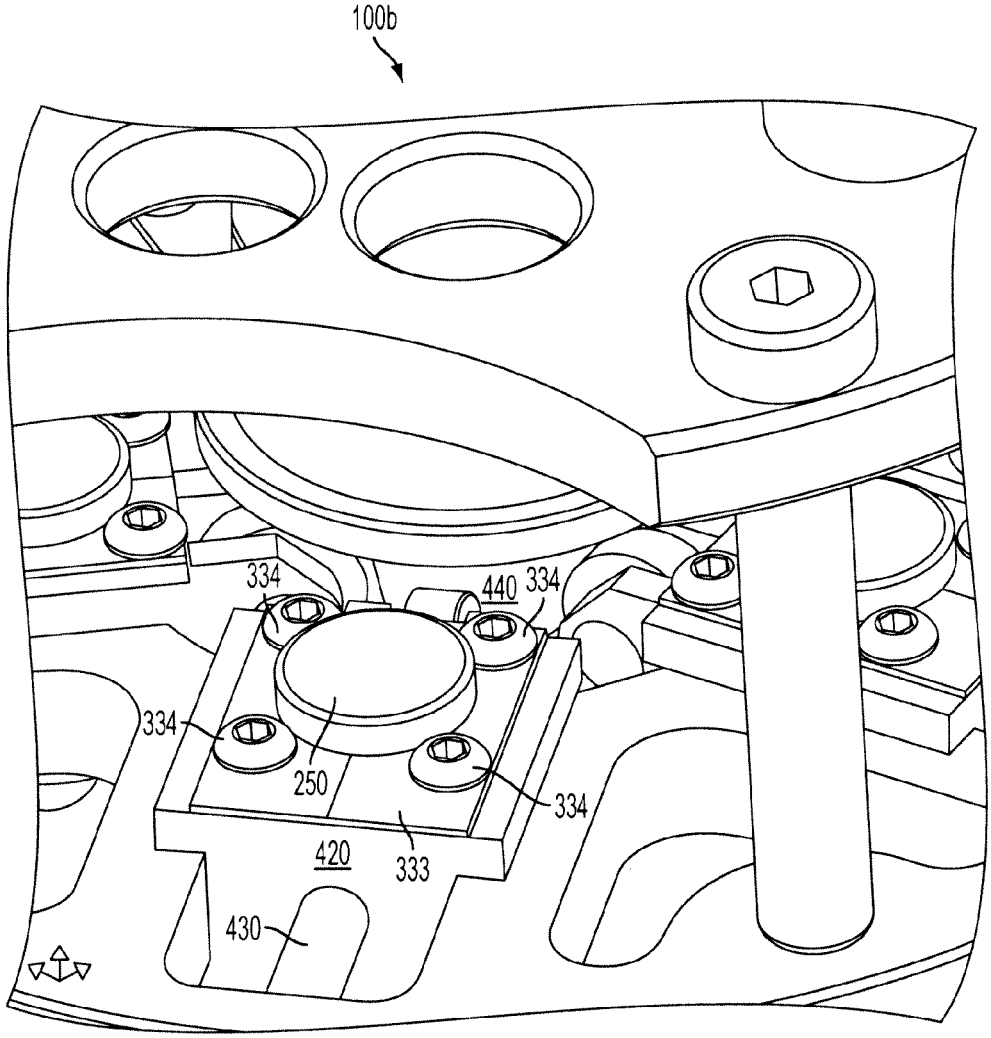
FIGS. 8-11 are schematics depicting various view of the embodiment depicted in FIG. 6.
Figure 9:
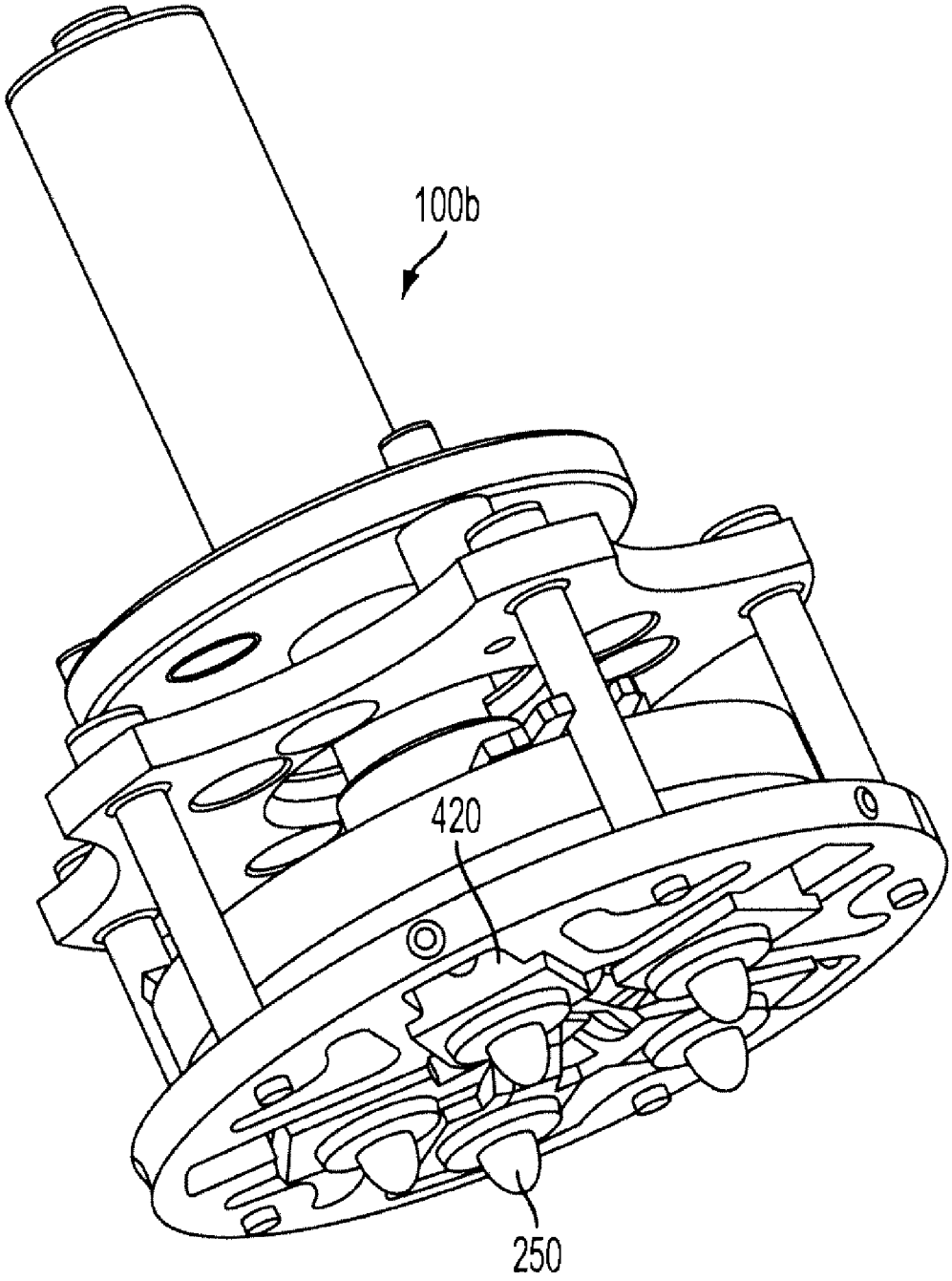
Figure 10:
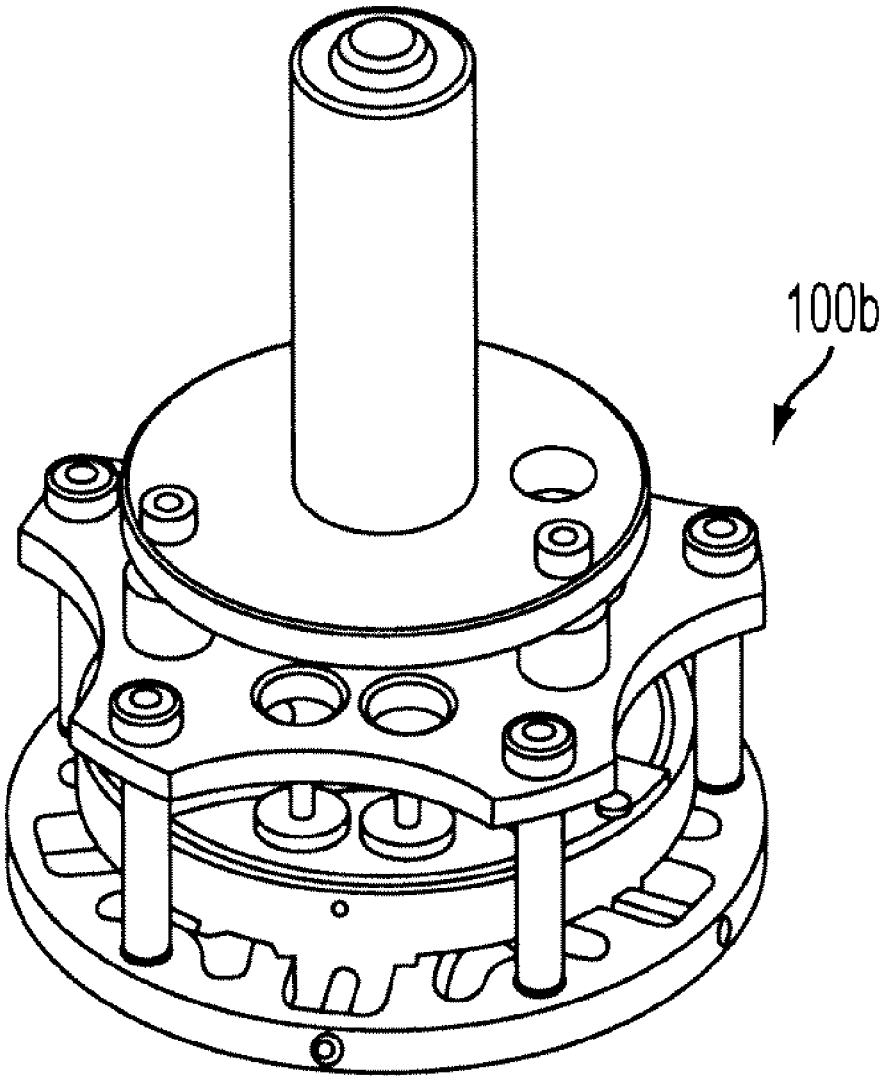
Figure 11:
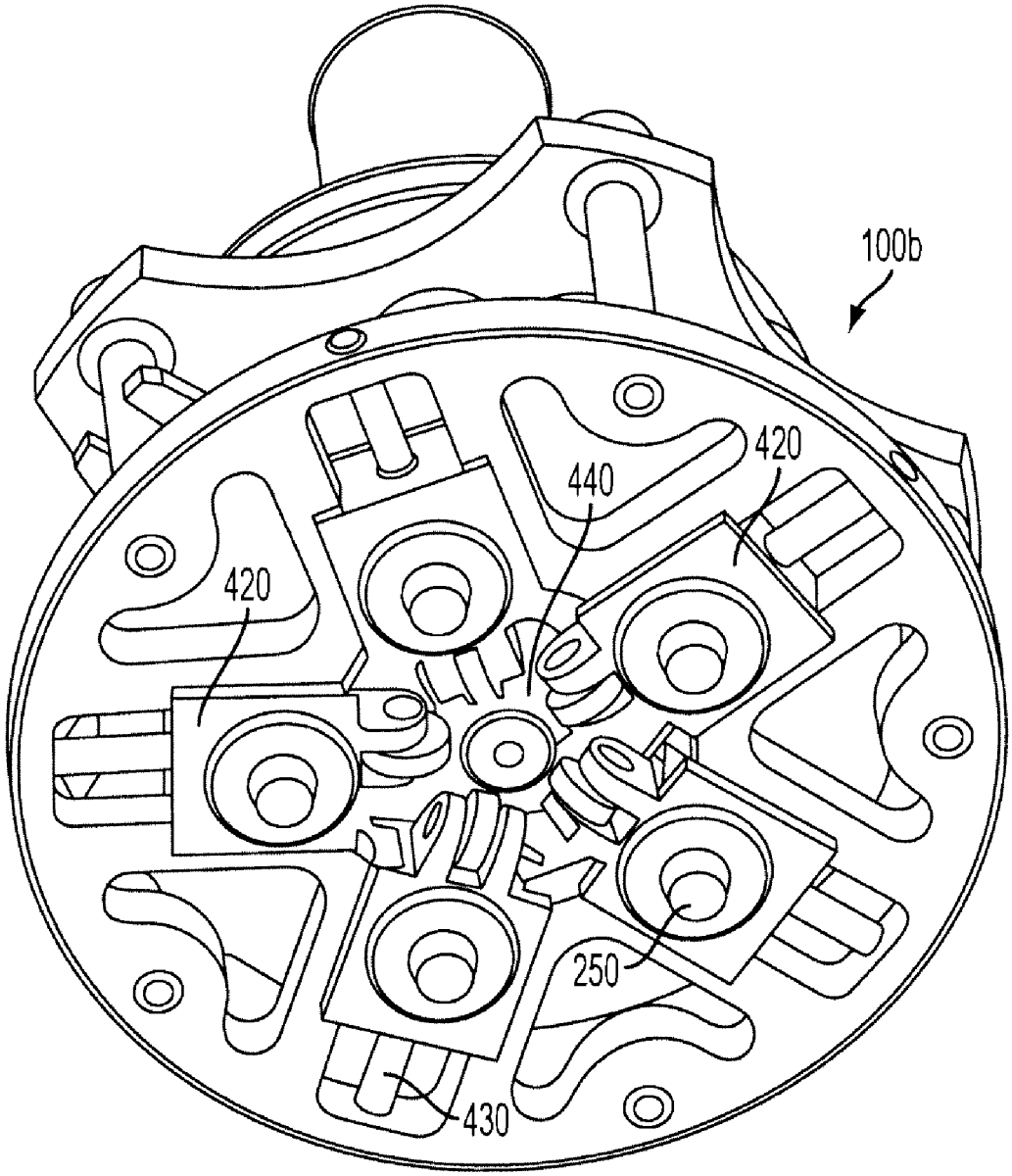

In some embodiments of the invention, utilizing burnishing buttons 250 allows for the removal and replacement of the burnishing surfaces without the need to replace the entire burnishing component. For example, the buttons 250 may be attached to the burnishing assembly with screws or clamps, allowing the buttons to be "changed out" in the event that the burnishing surfaces wear and/or break, etc. In this regard, FIG. 8 depicts buttons being held in place to the burnishing tool 100 by element 333, which is bolted to the burnishing tool with bolts 334.

As may have been noted, FIGS. 8-11 depicts a different arrangement for a burnishing tool 100*b* than that shown in FIGS. 1*a*-1*d* (burnishing tool 100) in that the tapered cam shaft 120 arrangement is not used, and instead the burnishing surfaces are mounted on trolleys 420 which ride on rails 430, where the trolleys are directed in the radial direction by conical cam 440. Thus, the burnishing buttons 250 may be utilized with various burnishing tool arrangements. This is also the case with the burnishing surfaces detailed above that do not extend substantially around the burnishing tool (e.g., only 180 degrees around the tool, etc.)

Figure 12:
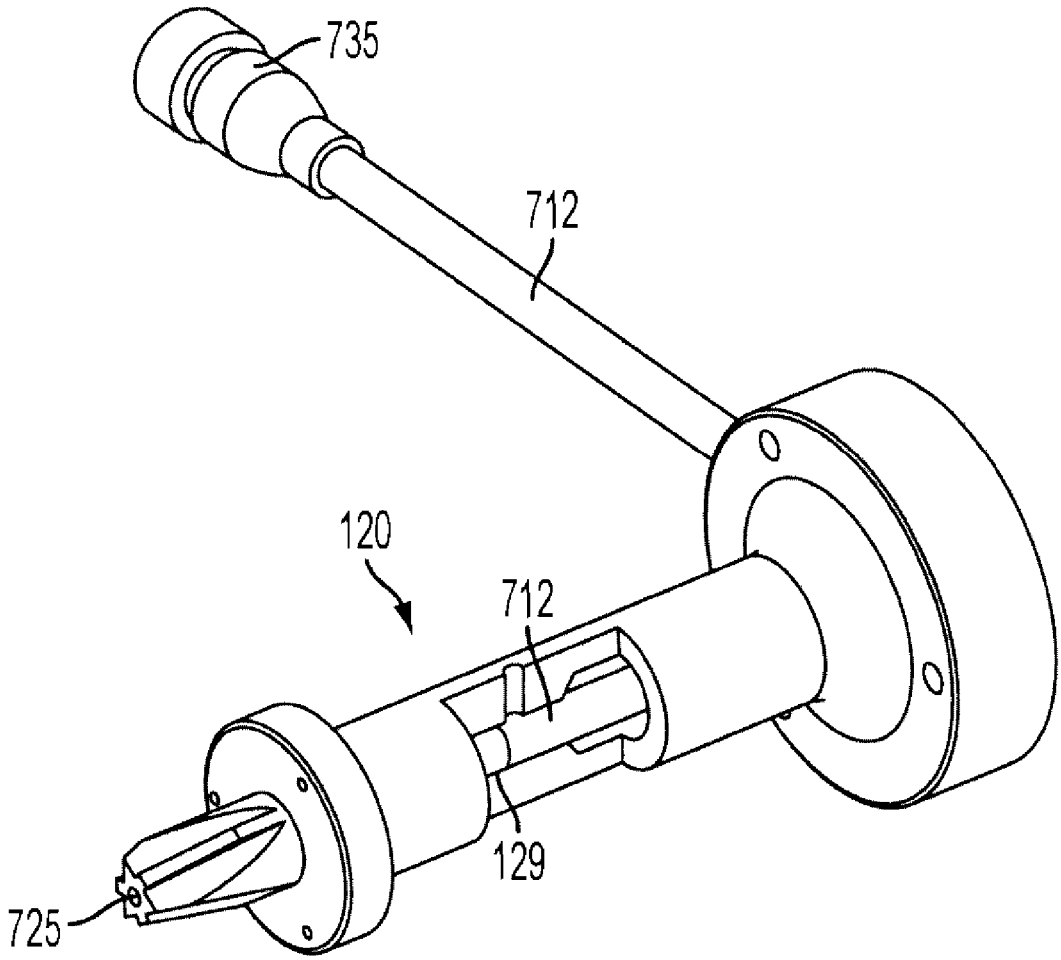
FIGS. 12 and 13 are schematics of an embodiment of the tool shaft utilized to implement some embodiments of the present invention where a heater is installed in the burnishing tool.
Figure 13:
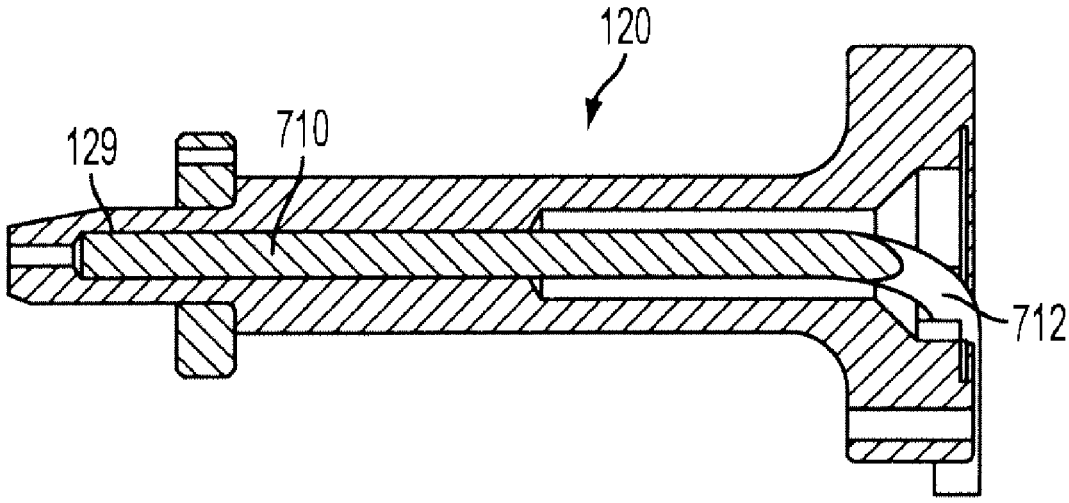

FIGS. 12 and 13 (the latter being a cross-section of FIG. 12), depict another embodiment of the present invention, wherein a heater 710 is located inside the cam shaft 120, such as, for example, inside hole 129, the hole having an axis that is substantially parallel to the cam shaft axis/centerline. In this embodiment, the heater is an electrical heater powered by wires 712. This heater heats the burnishing tool, which causes the burnishing tool to "iron" the surface of the container. Embodiments of the present invention may be practiced as depicted in FIG. 12, a thermocouple 725 is attached to the burnishing tool for monitoring a temperature of the tool and/or an area proximate the tool. Element 735 is an electrical connector adapted to connect to an electrical power source to provide power to the heater.

As may be seen in FIGS. 12 and 13, the tool includes a flange at the end of the cam shaft instead of merely a cylindrical shaft. The use of the flange is not limited to tools with heaters. In embodiments having this flange, the flange may be bolted to a tool mount through bolt holes in the flange instead of clamping the cylindrical shaft to a mount with screws as shown in FIG. 1*a*.

Figure 14:
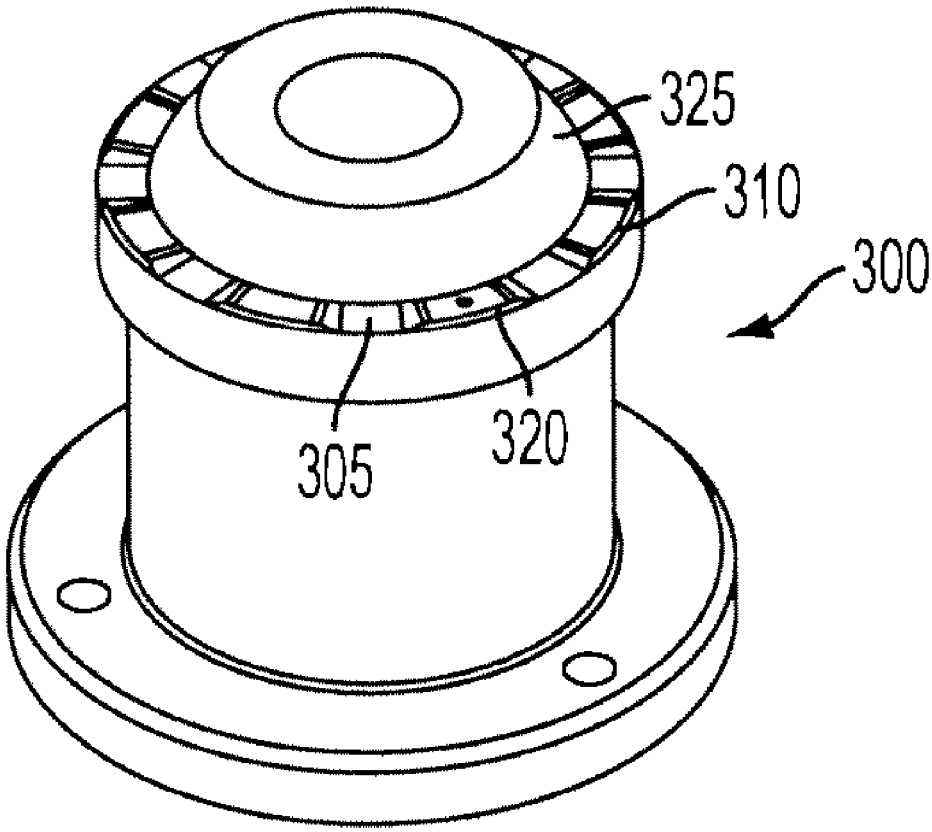
FIG. 14 presents another embodiment of the present invention, where the burnishing tool has fixed, non-movable, burnishing surfaces.

FIG. 14 presents another embodiment of the present invention. FIG. 14 is a schematic representation of a fixed, non-expanding burnishing tool 300. The burnishing tool 300 includes burnishing surfaces 310 arrayed about the longitudinal axis of the burnishing tool 300 that are separated by scallops 305. The burnishing tabs have burnishing surfaces 320 adapted to burnish the sealing surfaces of a container. Burnishing tool 300 also includes, in some embodiments, burnishing surface 325 which is angled with respect to burnishing surfaces 320. Burnishing tool 300 may be used in a manner concomitant with the use of burnishing tool 100 as depicted in FIG. 3.

A feature of the burnishing tool 300 is that it has an interrupted burnishing face created by the scallops 305 between the burnishing tabs 320. This interrupted burnishing face permits, for example, burrs or other non-smooth features on/near an opening of a plastic container to be smoothed out under application of at least one of pressure, heat and/or motion from the burnishing tool against the container. In some embodiments, the container is rotated, while in other embodiments the tool 300 is rotated, while in yet other embodiments, both are rotated. In some embodiments, the removal of the burrs/smoothing of the surface is accomplished, in whole or in part, through an ironing-like action akin to ironing a piece of wrinkled clothing with a hand iron. This ironing-like action is enhanced via the non-continuous burnishing surface.

As with the burnishing tool 100, burnishing tool 300 may include a heater. Burnishing tool 300 may also include a flange at the distal portion of the tool having bolt holes so that the tool 300 may be bolted to a tool mount through bolt holes in the flange. In other embodiments, the burnishing tool may include a shaft or the like to permit the shaft to be clamped to a tool mount along the lines of the mount depicted in FIG. 1*a*.

In some uses of the burnishing tool 300, the tool 300 and/or container is rotated and the opening of the container and the burnishing tabs 320 are brought into contact with each other such that material of the container is permitted to move, through at least one of plastic deformation and flow, from one portion of the container to the other portion of the container due to the scalloped portions 305 in the burnishing tool. That is, the scalloped portions 305 provide a relief for the moved material. This results in a smoothed out surface of the opening of the container.

Given the disclosure of the present invention, one versed in the art would appreciate that there are other embodiments and modifications within the scope and spirit of the present invention. Accordingly, all modifications attainable by one versed in the art from the present disclosure within the scope and spirit of the present invention are to be included as further embodiments of the present invention.

What is claimed is:

1. A method of smoothing a container, comprising:

rotating the container about a longitudinal axis of the container;

bringing together the container and a burnishing tool, comprising a tapered cam shaft, wherein the tapered cam shaft includes camming surfaces having a planar spatial orientation substantially the same as the planar spatial orientation of sides of a pyramid, wherein respective keys respectively extend along respective camming surfaces of the tapered cam shaft, the keys having respective longitudinal axis of extension parallel to the respective camming surfaces, and wherein the camming surfaces are arrayed about a cam shaft axis that is normal to a plane that is parallel to a base of the pyramid; a burnishing assembly, the burnishing assembly including: segmented burnishing components including respective cammed surfaces positioned on the tapered cam shaft adjacent respective camming surfaces, wherein the segmented burnishing components include respective keyways substantially extending along the respective cammed surfaces to accept the respective keys of the tapered cam shaft, the respective keyways having a longitudinal axis of extension substantially parallel to the longitudinal axis of extension of the respective keys, and wherein the segmented burnishing components have burnishing surfaces; and a carrier assembly, the carrier assembly applying force on the segmented machine components to hold the segmented machine components against the tapered cam shaft; wherein the burnishing tool is configured to permit adjustment of the position of the burnishing assembly with respect to the tapered cam shaft in the direction of the cam shaft axis to advance and retract the segmented burnishing components in a radial direction with respect to the cam shaft axis due to movement of the cammed surfaces of the segmented burnishing components along the respective camming surfaces of the cam shaft, such that a portion of the container contacts at least one of the burnishing surfaces of the respective segmented burnishing components; and burnishing the container via contact between the at least one of the burnishing surfaces and the container while the container is rotating.

2. The method of claim 1, further comprising:

advancing the segmented burnishing components in the radial direction with respect to the cam shaft axis as a result of pressure from the container on at least one of the burnishing surfaces that drives the segmented burnishing components along the cam shaft axis.

3. The method of claim 1, further comprising:

heating the burnishing components utilizing a heater.

4. A method of smoothing a container, comprising:

rotating a burnishing tool, comprising a tapered cam shaft, wherein the tapered cam shaft includes camming surfaces having a planar spatial orientation substantially the same as the planar spatial orientation of sides of a pyramid, wherein respective keys respectively extend along respective camming surfaces of the tapered cam shaft, the keys having respective longitudinal axis of extension parallel to the respective camming surfaces, and wherein the camming surfaces are arrayed about a cam shaft axis that is normal to a plane that is parallel to a base of the pyramid; a burnishing assembly, the burnishing assembly including: segmented burnishing components including respective cammed surfaces positioned on the tapered cam shaft adjacent respective camming surfaces, wherein the segmented burnishing components include respective keyways substantially extending along the respective cammed surfaces to accept the respective keys of the tapered cam shaft, the respective keyways having a longitudinal axis of extension substantially parallel to the longitudinal axis of extension of the respective keys, and wherein the segmented burnishing components have burnishing surfaces; and a carrier assembly, the carrier assembly applying force on the segmented burnishing components to hold the segmented burnishing components against the tapered cam shaft; wherein the burnishing tool is configured to permit adjustment of the position of the burnishing assembly with respect to the tapered cam shaft in the direction of the cam shaft axis to advance and retract the segmented burnishing components in a radial direction with respect to the cam shaft axis due to movement of the cammed surfaces of the segmented burnishing components along the respective camming surfaces of the cam shaft; and bringing together the container and the burnishing tool such that the container contacts at least one of the burnishing surfaces of the respective segmented burnishing components; and burnishing the container via contact between the at least one of the burnishing surfaces and the container while the burnishing tool is rotating.

5. A method of smoothing a container, comprising:

bringing together the container and a burnishing tool such that an opening of the container contacts at least one burnishing surface of a burnishing component of the burnishing tool;

advancing the at least one burnishing surface of the burnishing component in the radial direction with respect to the longitudinal axis of the container as result of pressure on the at least one burnishing surface from the container that drives the burnishing surfaces of the burnishing tool in the direction of the longitudinal axis so that the burnishing component is cammed by a tapered cam shaft of the tool, wherein the tapered cam shaft includes camming surfaces having a planar spatial orientation substantially the same as the planar spatial orientation of sides of a pyramid, wherein respective keys respectively extend along respective camming surfaces of the tapered cam shaft, the keys having respective longitudinal axis of extension parallel to the respective camming surfaces, and wherein the camming surfaces are arrayed about a cam shaft axis that is normal to a plane that is parallel to a base of the pyramid; and burnishing the container via contact between the at least one of the burnishing surfaces and the container by rotating at least one of the container and the burnishing tool.

6. A method of smoothing a container, comprising:

rotating the container about a longitudinal axis of the container;

bringing together the container and a burnishing tool, comprising a plurality of burnishing surfaces arrayed about a longitudinal axis of the burnishing tool substantially on the same plane, wherein the plurality of burnishing surfaces are respectively separated by sections of the tool that at least one of (i) does not have a burnishing surface and (ii) does not have a burnishing surface on the same plane as the plurality of burnishing surfaces, and wherein the burnishing surfaces are non-movable, such that an opening of the container contacts at least one of the burnishing surfaces; and burnishing the container via contact between the at least one of the burnishing surfaces and the container while the container is rotating.

* * * * *